US007964813B2

(12) United States Patent
Ting et al.

(10) Patent No.: US 7,964,813 B2
(45) Date of Patent: Jun. 21, 2011

(54) KEY STRUCTURE

(75) Inventors: Yu-Hsiang Ting, Tu-Cheng (TW); Chia-Fa Cheng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 212 days.

(21) Appl. No.: 12/453,897

(22) Filed: May 27, 2009

(65) Prior Publication Data

US 2010/0300858 A1 Dec. 2, 2010

(51) Int. Cl.
*H01H 13/70* (2006.01)

(52) U.S. Cl. ..... 200/344

(58) Field of Classification Search ..... 200/344, 200/341, 345; 400/490, 495
See application file for complete search history.

(56) References Cited

U.S. PATENT DOCUMENTS

| | | | | |
|---|---|---|---|---|
| 6,137,071 | A * | 10/2000 | Yeh et al. | 200/344 |
| 6,242,705 | B1 * | 6/2001 | Huang | 200/520 |
| 2010/0300857 | A1 * | 12/2010 | Cheng et al. | 200/344 |
| 2010/0314231 | A1 * | 12/2010 | Ting et al. | 200/344 |

* cited by examiner

*Primary Examiner* — Edwin A. Leon
*Assistant Examiner* — Vanessa Girardi
(74) *Attorney, Agent, or Firm* — Rosenberg, Klein & Lee

(57) ABSTRACT

A key structure has a fixing base. The fixing base includes a fixing board, and a plurality of platforms extending upwards from a top of the fixing board and spaced away from each other. Each of the platforms is formed with a restraining hole at a top thereof. A resilient assembly adhered onto the fixing board has a resilient portion which is placed among the platforms. A key cap is resiliently supported by the resilient portion to suspend above the fixing base, and has a plurality of guiding rods extending downwards from a bottom thereof and movably inserted into the corresponding restraining holes for guiding the key cap to move upwards and downwards with respect to the fixing base.

4 Claims, 3 Drawing Sheets

KEY STRUCTURE

BACKGROUND OF THE INVENTION

1. Field of the Invention

The present invention relates to a key structure, and more particularly to a key structure which is simple for use in a computer keyboard.

2. The Related Art

U.S. Pat. No. 7,498,536 describes a key structure of a computer keyboard which comprises a key cap, a linkage mechanism, a fixed base, a resilient assembly, a membrane circuit board and a supporting board under the membrane circuit board. The linkage mechanism is disposed between the key cap and the fixing base, and includes a first supporting frame and a second supporting frame, which pivot together to form a scissors-shaped structure. The resilient assembly is placed on the membrane circuit board and passes through the fixing base to elastically support the key cap, as a switch. When the key cap is pressed, the resilient assembly is driven downwards and then becomes the switch that can trigger the corresponding circuit on the membrane circuit board to generate an electronic signal. However, such key structure is complicated, which not only takes more manufacturing and assembling time, but also increases cost.

SUMMARY OF THE INVENTION

Accordingly, an object of the present invention is to provide a key structure which is simple for use in a computer keyboard. The key structure has a fixing base. The fixing base includes a fixing board, and a plurality of platforms extending upwards from a top of the fixing board and spaced away from each other. Each of the platforms is formed with a restraining hole at a top thereof. A resilient assembly adhered onto the fixing board has a resilient portion which is placed among the platforms. A key cap is resiliently supported by the resilient portion to suspend above the fixing base, and has a plurality of guiding rods extending downwards from a bottom thereof and movably inserted into the corresponding restraining holes for guiding the key cap to move upwards and downwards with respect to the fixing base.

As described above, the guiding rods depend from the bottom of the key cap and are movably inserted into the restraining holes of the fixing base. When the key cap is pressed downwards, the guiding rods slide downwards in restraining holes to trigger a circuit for generating an electronic signal. Such connecting construction is simple and easy to manufacture and assembly.

BRIEF DESCRIPTION OF THE DRAWINGS

The present invention will be apparent to those skilled in the art by reading the following description of a thereof, with reference to the attached drawings, in which.

DETAILED DESCRIPTION OF THE EMBODIMENT

Figure 1:
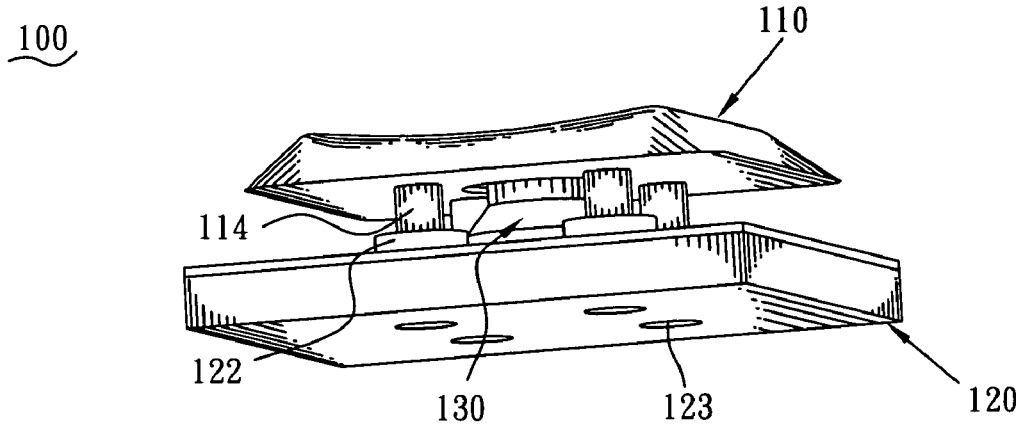
FIG. 1 is an assembled, perspective view of a key structure of an embodiment in according to the present invention.
Figure 2:
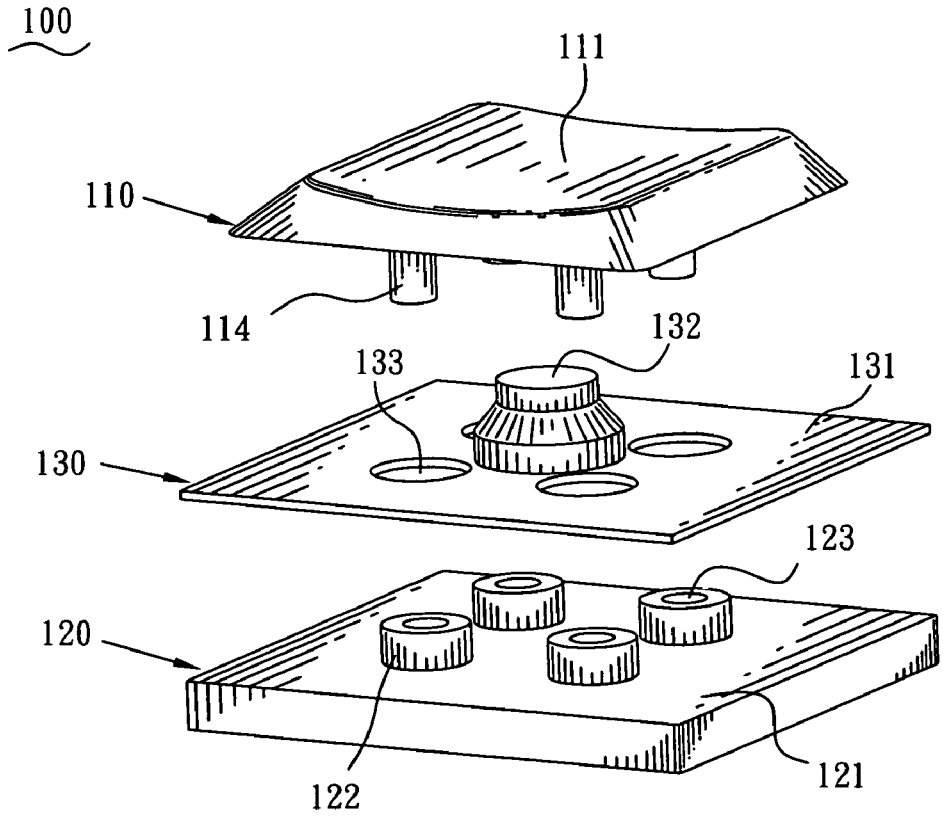
FIG. 2 is an exploded, perspective view of the key structure shown in FIG. 1.
Figure 3:
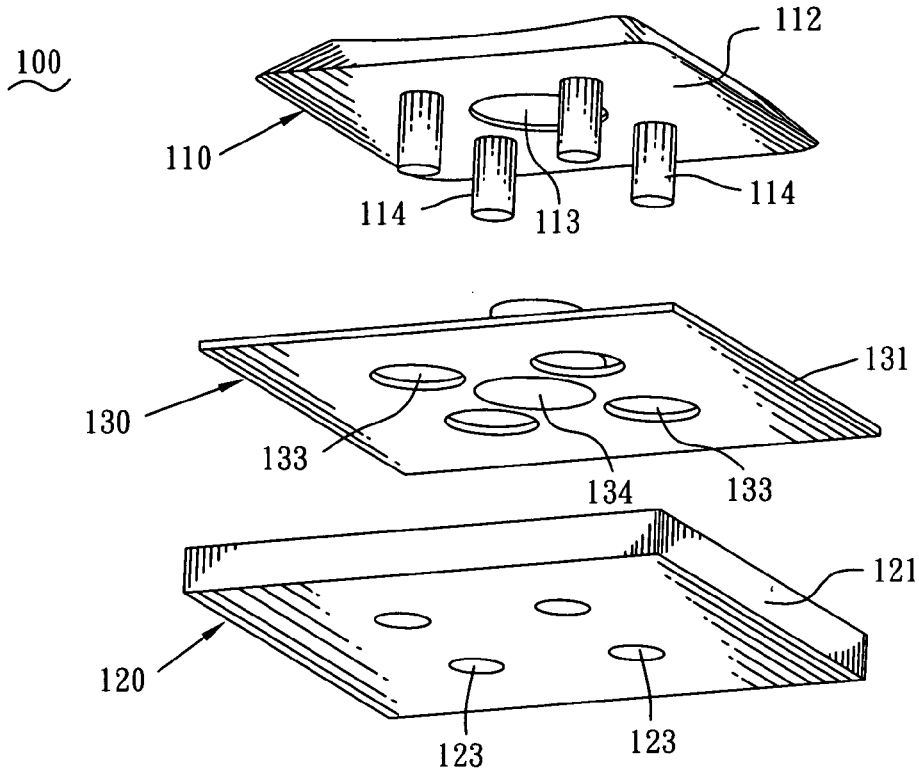
FIG. 3 is an exploded, perspective view of the key structure shown in FIG. 2 viewed from another angle.

With reference to FIGS. 1-3, a key structure 100 in accordance with the present invention comprises a key cap 110, a fixing base 120 disposed under and spaced away from the key cap 110, and a resilient assembly 130 placed between the key cap 110 and the fixing base 120. The key cap 110 is substantially shaped like a square cap, and defines a top 111 and a bottom 112. The bottom 112 has a circular recess 113 at a middle portion thereof and a plurality of guiding rods 114 disposed around the recess 113. The guiding rods 114 are the same length. In this embodiment, there are four guiding rods 114, located symmetrically about the recess 113.

The fixing base 120, which may be made of plastic material, has a rectangular fixing board 121. A top surface of the fixing board 121 is extended upwards to form a plurality of circular platforms 122. In this embodiment, the platforms 122 are arranged in matrix, corresponding to the guiding rods 114. Each of the platforms 122 has a restraining hole 123 passing through the whole fixing board 121. The restraining hole 123 has a diameter larger than that of the guiding rod 114 for allowing the guiding rod 114 to move upwards and downwards therein smoothly.

The resilient assembly 130 is manufactured with plastic material and has a rectangular flat board 131 and a resilient portion 132 on a middle of the flat board 131. The flat board 131 is adhered on the fixing base 120 and has four through holes 133, around the resilient portion 132 and corresponding to the platforms 122 for positioning the resilient assembly 130 to the fixing base 120. The resilient portion 132, made of an elastomer such as rubber, is substantially an inverted-bowl shape. Herein, the flat board 131 further has an opening 134 located among the through holes 133 and communicating with a chamber formed by the resilient portion 132. A top of the resilient portion 132 is received in the recess 113 of the key cap 110 when the key cap 110 is assembled to the flat board 131. In this embodiment, the top of the resilient portion 132 can be stuck to a bottom of the recess 113 by adhesive, for securing the key cap 110 and the resilient assembly 130 firmly.

Figure 4:
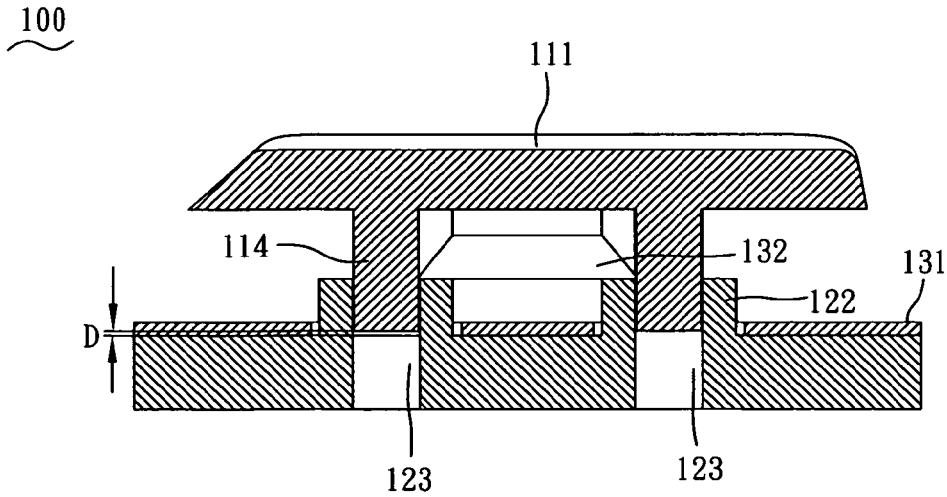
FIG. 4 is a cross-sectional view of the key structure shown in FIG. 1.

Please refer to FIG. 4, the resilient assembly 130 is placed on the fixing base 120, with the platforms 122 passing through the through holes 133. The key cap 110 is supported by the resilient portion 132 to suspend above the flat board 131. The guiding rods 114 are movably inserted into the corresponding restraining holes 123 for guiding the key cap 110 to move upwards and downwards with respect to the fixing base 120. At an original position where the key cap 110 is not pressed, a bottom of the guiding rod 114 is spaced away from a plane of a top of the fixing base 120 with a short distance, named clearance D. A circuit board (not show) is located in the restraining hole 123, as a switch. When the key cap 110 is pressed downwards, the resilient portion 132 is compressed to make the guiding rods 114 move downwards. The guiding rods 114 trigger the corresponding circuit on the circuit board to generate an electronic signal.

Figure 5:
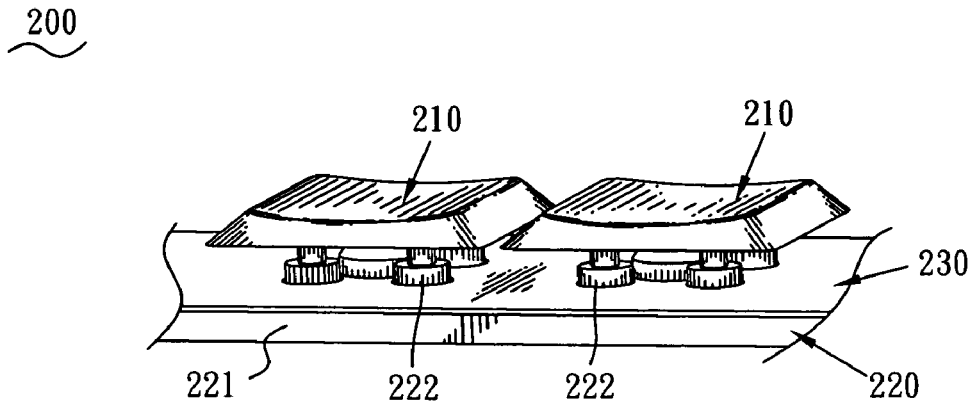
FIG. 5 is a partially assembled perspective view of a keyboard.
Figure 6:
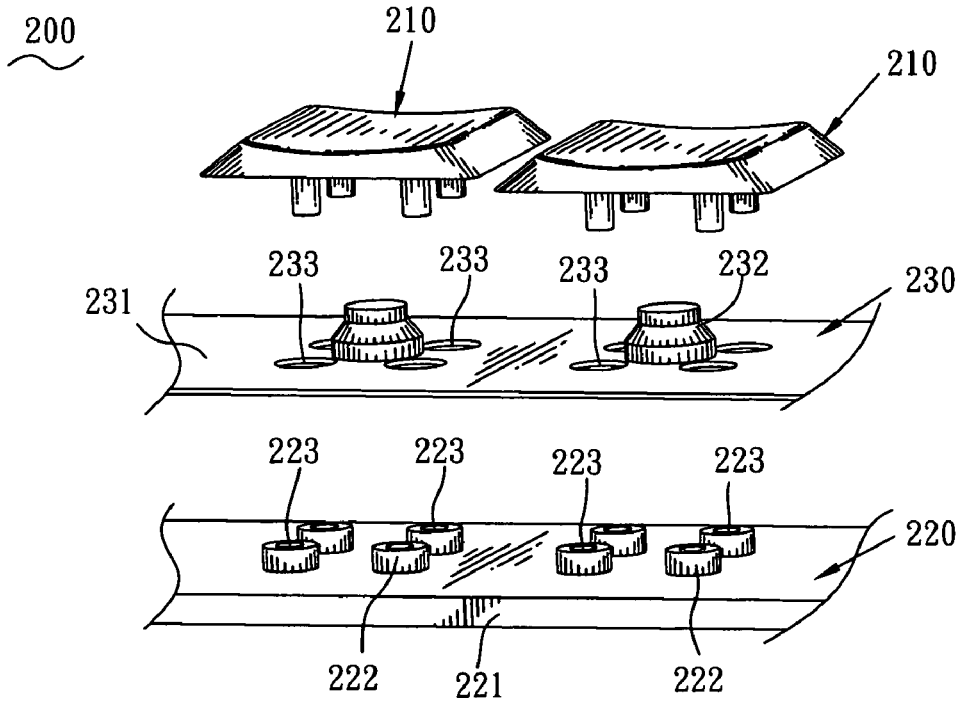
FIG. 6 is a partially exploded perspective view of the keyboard shown in FIG. 5.

Referring to FIGS. 5-6, a keyboard 200 of which a key structure is analogue to the key structure 100 comprises a plurality of key caps 210, a fixing base 220, and a resilient assembly 230. The fixing base 220 has a fixing board 221, and a plurality of sets of platforms 222, with restraining holes 223 formed thereon, molded by a plastic-injecting mold. The resilient assembly 230 has a flat board 231, which has a plurality of sets of through holes 233 corresponding to the platforms 222 and a plurality of resilient portions 232 formed among the corresponding through holes 233. In assembly, the resilient assembly 230 is disposed on the fixing base 220, with platforms 222 passing through the respective through holes 233. The key caps 210, with the same structure as that of the key caps 110, are fixed to the corresponding resilient portions 232.

As described above, the key cap 110 is movably mounted to the fixing base 120 by the guiding rods 114 sliding in the restraining holes 123, which is simple and easy to manufacture and assembly. Furthermore, the platforms 222 of the fixing base 220 can be molded with the fixing board 221 in one time, which can reduce manufacturing time and cost of the keyboard 200.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A key structure, comprising:

a fixing base having a fixing board, and a plurality of platforms extending upwards from a top of the fixing board and spaced away from each other, each of the platforms formed with a restraining hole at a top thereof;

a resilient assembly adhered onto the fixing board having a resilient portion which is placed among the platforms; and a key cap resiliently supported by the resilient portion to suspend above the fixing base, the key cap having a plurality of guiding rods extending downwards from a bottom thereof and movably inserted into the corresponding restraining holes for guiding the key cap to move upwards and downwards with respect to the fixing base.

2. The key structure as claimed in claim 1, wherein the bottom of the key cap further has a recess among the guiding rods for receiving a top of the resilient portion.

3. The key structure as claimed in claim 2, wherein the resilient portion is connected with the key cap through the use of adhesive.

4. The key structure as claimed in claim 1, wherein the resilient assembly has a flat board, the resilient portion of an inverted-bowl shape on a middle of the flat board, and a plurality of through holes formed at the flat board and around the resilient portion for allowing the platforms to pass therethrough.

* * * * *